US012084934B2

(12) United States Patent
Wurtz et al.

(10) Patent No.: US 12,084,934 B2
(45) Date of Patent: Sep. 10, 2024

(54) SLOT CUTTER SYSTEM AND OPERATIONS

(71) Applicant: Schlumberger Technology Corporation, Sugar Land, TX (US)

(72) Inventors: Joshua Wurtz, Houston, TX (US); Joseph Matthew Casassa, Sugar Land, TX (US); Christopher Albert Babin, Waveland, MS (US); Robert Kyle Wiesenborn, Richmond, TX (US); Pierre-Arnaud Foucher, Houston, TX (US); David Engel, Houston, TX (US); Todor Sheiretov, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 17/809,080

(22) Filed: Jun. 27, 2022

(65) Prior Publication Data

US 2022/0412180 A1 Dec. 29, 2022

Related U.S. Application Data

(60) Provisional application No. 63/202,832, filed on Jun. 25, 2021.

(51) Int. Cl.
*E21B 29/00* (2006.01)

(52) U.S. Cl.
CPC ..... *E21B 29/002* (2013.01)

(58) Field of Classification Search
CPC ..... E21B 29/00; E21B 29/002; E21B 29/005; E21B 29/06; E21B 29/08; E21B 31/16; E21B 31/20
See application file for complete search history.

(56) References Cited

U.S. PATENT DOCUMENTS 1,030,992 A 7/1912 Fulmer
1,785,419 A 12/1930 Moss
(Continued)

FOREIGN PATENT DOCUMENTS

CN 101012746 A 8/2007
CN 102102510 A 6/2011
(Continued)

OTHER PUBLICATIONS

International Search Report and Written Opinion issued in PCT Application PCT/US2018/052171 dated Jan. 17, 2019 (18 pages).
(Continued)

*Primary Examiner* — David Carroll
(74) *Attorney, Agent, or Firm* — Ashley E. Brown

(57) ABSTRACT

Devices, systems and methods for cutting openings in a wellbore tubular by a slot cutting assembly having an anchoring system and a slot cutting tool. The anchoring assembly anchors the slot cutting assembly within the wellbore. The slot cutting tool has an extendable cutting blade that is pushed into the wellbore tubular to cut an opening through the tubular. The slot cutting tool may have an extendable stabilizing arm to stabilize and assist with cutting by the blade. The slot cutting assembly may have azimuth and depth sensors to assist with positioning the tool at a desired position downhole. A surface system may be used to control the position of the slot cutting assembly downhole.

19 Claims, 6 Drawing Sheets

(56) References Cited

U.S. PATENT DOCUMENTS

| | | | | |
|---|---|---|---|---|
| 2,160,150 | A | 5/1939 | Jimerson et al. | |
| 2,500,402 | A | 3/1950 | Craig | |
| 2,588,408 | A | 3/1952 | O'leary | |
| 2,713,992 | A | 7/1955 | Snyder | |
| 3,167,122 | A | 1/1965 | Lang | |
| 3,225,828 | A | 12/1965 | Wisenbaker et al. | |
| 4,325,436 | A | 4/1982 | Richter et al. | |
| 5,069,282 | A | 12/1991 | Taylor | |
| 5,170,843 | A | 12/1992 | Taylor | |
| 5,695,015 | A | 12/1997 | Barr et al. | |
| 5,706,896 | A | 1/1998 | Tubel et al. | |
| 5,785,120 | A | 7/1998 | Smalley et al. | |
| 5,832,998 | A | 11/1998 | Decker et al. | |
| 5,899,268 | A | 5/1999 | Lynde et al. | |
| 6,024,166 | A | 2/2000 | McGarian et al. | |
| 6,668,945 | B2 | 12/2003 | Ohmer | |
| 6,851,475 | B2 | 2/2005 | Simpson et al. | |
| 6,868,901 | B2 | 3/2005 | Mason et al. | |
| 7,575,056 | B2 | 8/2009 | Fuhst et al. | |
| 7,762,028 | B2 | 7/2010 | Valentz et al. | |
| 7,909,100 | B2 | 3/2011 | Bryant, Jr. et al. | |
| 8,789,598 | B1 | 7/2014 | Mlcak et al. | |
| 10,683,719 | B2 | 6/2020 | Motland | |
| 2003/0234121 | A1 | 12/2003 | Taylor et al. | |
| 2005/0092494 | A1 | 5/2005 | McElroy et al. | |
| 2005/0092495 | A1 | 5/2005 | Evans | |
| 2005/0150693 | A1 | 7/2005 | Madden | |
| 2006/0169456 | A1 | 8/2006 | Evans | |
| 2006/0207796 | A1 | 9/2006 | Stewart | |
| 2007/0084637 | A1 | 4/2007 | Orban et al. | |
| 2007/0151732 | A1 | 7/2007 | Clemens et al. | |
| 2008/0087424 | A1 | 4/2008 | McLaughlin | |
| 2010/0258293 | A1 | 10/2010 | Lynde et al. | |
| 2011/0209872 | A1 | 9/2011 | McAfee et al. | |
| 2011/0297380 | A1 | 12/2011 | Alberty et al. | |
| 2012/0029702 | A1 | 2/2012 | Tverlid | |
| 2012/0043089 | A1 | 2/2012 | Hoffman et al. | |
| 2014/0124191 | A1 | 5/2014 | Hallundbæk | |
| 2014/0311729 | A1 | 10/2014 | Pasvandi | |
| 2014/0360784 | A1 | 12/2014 | Hunziker et al. | |
| 2015/0167394 | A1 | 6/2015 | Xia et al. | |
| 2015/0376966 | A1 | 12/2015 | Balasubramanian et al. | |
| 2016/0032696 | A1 | 2/2016 | Caccialupi et al. | |
| 2016/0130904 | A1 | 5/2016 | Andersen | |
| 2016/0138369 | A1* | 5/2016 | Tunget | E21B 37/02 166/174 |
| 2016/0258254 | A1 | 9/2016 | Guo et al. | |
| 2016/0319618 | A1* | 11/2016 | Motland | E21B 29/00 |
| 2017/0175475 | A1 | 6/2017 | Kartha et al. | |
| 2018/0003001 | A1* | 1/2018 | Pipchuk | E21B 33/138 |
| 2019/0063214 | A1 | 2/2019 | Castillo | |
| 2020/0190951 | A1* | 6/2020 | Teurlay | E21B 43/112 |
| 2020/0332615 | A1* | 10/2020 | Wiesenborn | E21B 34/14 |

FOREIGN PATENT DOCUMENTS

| | | | |
|---|---|---|---|
| CN | 106194158 | A | 6/2016 |
| CN | 106687242 | A | 5/2017 |
| EP | 2813665 | A1 | 12/2014 |
| GB | 2129350 | A | 5/1984 |
| RU | 2315177 | C1 | 1/2008 |
| WO | 03069116 | A1 | 8/2003 |
| WO | 2010085154 | A9 | 9/2010 |
| WO | 2012054445 | A2 | 4/2012 |
| WO | 2012074755 | A3 | 8/2012 |
| WO | 2013134629 | A1 | 9/2013 |
| WO | 2015112022 | A1 | 7/2015 |
| WO | 2016028155 | A1 | 2/2016 |
| WO | 2016085490 | A1 | 6/2016 |
| WO | 2020006333 | A1 | 1/2020 |

OTHER PUBLICATIONS

International Search Report and Written Opinion issued in PCT Application PCT/US2018/052164 dated Mar. 6, 2019 (12 pages).
International Preliminary Report on patentability issued in PCT Application PCT/US2018/052171 dated Apr. 2, 2020 (15 pages).
International Preliminary Report on Patentability issued in PCT Application PCT/US2018/052164 dated Apr. 2, 2020 (8 pages).
Partial Supplementary Search Report of European Patent Application No. 18858532.7 dated May 18, 2021, 11 pages.
Extended Search Report of European Patent Application No. 18858532.7 dated Oct. 4, 2021, 10 pages.
Search Report of Chinese Patent Application No. 201880075070X dated Nov. 10, 2021, 7 pages with English Translation.
Substanative Exam issued in Saudi Arabian Patent Application No. 520411583 dated Mar. 29, 2022, 11 pages with English translation.
Second Office Action issued in Chinese Patent Application No. 201880075070.X dated Jun. 15, 2022, 9 pages with English translation.
Substantive Examination Report issued in Saudi Arabian Patent Application No. 520411583 dated Sep. 26, 2022, 10 pages with English translation.
Search Report and Written Opinion issued in the PCT Application PCT/US2022/035067 dated Oct. 18, 2022, 11 pages.
Office Action issued in U.S. Appl. No. 16/649,478 dated Oct. 18, 2021, 9 pages.
Office Action issued in U.S. Appl. No. 16/649,478 dated Apr. 4, 2022, 17 pages.
Notice of Allowance issued in U.S. Appl. No. 16/649,478 dated Sep. 23, 2022, 7 pages.
Search Report and Written Opinion issued in the PCT Application PCT/US2022/035083 dated Oct. 14, 2022, 12 pages.
Third Office Action issued in Chinese Patent Application No. 201880075070.X dated Oct. 21, 2022, 11 pages with English translation.
International Search Report and Written Opinion issued in the PCT Application PCT/US2022/042166 dated Dec. 9, 2022, 12 pages.
Office Action issued in U.S. Appl. No. 17/823,757 dated May 2, 2023, 20 pages.
Rejection Decision issued in China Patent Application No. 201880075070.X dated Jun. 30, 2023, 17 pages.
Schlumberger, ReSOLVE iX Slot Cutter, Mar. 2021, 9 pages.
International Preliminary Report on Patentability issued in the PCT Application No. PCT/US2022/035067 dated Jan. 4, 2024, 7 pages.
International Preliminary Report on Patentability issued in the PCT Application No. PCT/US2022/035083 dated Jan. 4, 2024, 8 pages.
International Preliminary Report on Patentability issued in the PCT Application No. PCT/US2022/042166 dated Mar. 14, 2024, 8 pages.

* cited by examiner

SLOT CUTTER SYSTEM AND OPERATIONS

This application claims priority to U.S. provisional patent application Ser. No. 63/202,832 filed Jun. 25, 2021, which is hereby incorporated by reference herein.

BACKGROUND

The present invention relates to a device for cutting openings in a downhole tubular, such as casing or production tubing. A typical well has a casing installed in the well hole that is held in place with cement between the outside of the casing and the formation. To obtain production from certain areas of the formation, openings are made through the casing and cement to allow liquid and gas from the formation to flow into the center of the casing and up to the surface. A production tubing also may be used to extract liquid and gas. Mature wells often need to be stimulated to increase productivity and to increase the life span of the well. One way to achieve this is by creating additional holes or slots in the casing to provide added flow density or patterns.

Creating openings in a casing or tubular is a complicated process. One method requires removal of the casing so that holes may be cut. This is a time-consuming process that requires lifting the casing string to the surface, disconnecting casing sections in the process. Holes or slots are then cut at the surface into the desired casing, and then the casing string must be reconnected and reinstalled downhole. Well production is halted during this time and cannot be resumed until the casing string is completely reinstalled into the desired position. This process imposes additional cost in the form of lost production time and the labor to remove the casing, create the openings, and then reinstall the casing.

Instead of removing the casing, openings may be created using a perforator gun containing explosive charges. The explosives blast holes in the casing and into the surrounding formation, thereby creating access holes for the surrounding formation into the wellbore. However, explosives can damage the cement behind the casing tubular, which can lead to well integrity issues and potentially require removal and replacement of the casing tubular. Such additional work costs time and disrupts operation of the well. Another disadvantage of a perforator gun is that the explosives are one time use. The perforator gun cannot be used to repeatedly create holes without first raising the perforator gun to the surface and refurbishing the gun with replacement explosive charges or installing a new gun. The gun then must be lowered back downhole so that the additional holes can be created. This process must be repeated as additional holes are desired. These additional steps require additional time, parts, and labor, along with lost production time.

As a result, a need exists for systems and methods to create slots or holes in a tubular while it is installed downhole that also does not affect the integrity of the installed tubular or the well. A need exists for systems and methods that cut slots or holes in a downhole tubular at specifically desired locations, both in depth and azimuthal orientation. Moreover, a need further exists for such a system and method that can make repeated slots or holes without removing equipment from the well.

SUMMARY

Examples described herein include devices, systems and methods for cutting one or more openings in a wellbore tubular, such as casing or tubing, using a slot cutting assembly. The slot cutting assembly has an anchoring system with extendable arms that contact the inner wall of the tubular to hold the tool in place. Cutting is performed by a slot cutting tool in the slot cutting assembly that has a rotating cutting blade that can be extended into the tubular, thereby cutting an opening through the tubular. The slot cutting tool also may have an extendable stabilizing arm to stabilize and assist with cutting by the blade. The slot cutting assembly can have multiple slot cutting tools as well as depth and azimuth sensors to confirm that the tool is placed at a desired position downhole.

In another example, a slot cutting assembly is part of a system that also includes a surface system. The surface system has a deployable cable attached to the slot cutting assembly and controls the depth of the slot cutting assembly by extending or retrieving the cable. The surface system can assist with setting the slot cutting assembly and a desired position downhole. The surface system also can be used to perform repeated cutting by the slot cutting assembly by repositioning the assembly after a cut.

In another example, a slot cutting assembly is used in methods to create one or more openings in a wellbore tubular. The anchoring system is activated to hold the slot cutting assembly in the desired position. The slot cutting tool is used to cut an opening in the tubular at that position. After performing a cut, the slot cutting assembly may be repositioned to a new depth or azimuth, such as by the surface system. Additional cuts can then be performed by the slot cutting tool to create multiple openings in the wellbore tubular.

Both the foregoing general description and the following detailed description are exemplary and explanatory only and are not restrictive of the examples, as claimed.

DESCRIPTION OF THE EXAMPLES

Reference will now be made in detail to the present examples, including examples illustrated in the accompanying drawings. Wherever possible, the same reference numbers will be used throughout the drawings to refer to the same or like parts.

Examples described herein include devices, systems, and methods for cutting openings in a wellbore casing by a slot cutting assembly having an anchoring system and a slot cutting tool. The anchoring assembly anchors the tool within the casing to maintain the position of the tool. The slot cutting tool has an extendable cutting blade that is pushed into the casing to cut an opening through the tubular. The slot cutting tool also may have a stabilizing arm opposite the cutting blade to provide stability and assist in cutting operations. A surface system may be used to control the position of the tool downhole based in part upon depth and azimuth sensors in the tool. Multiple cutting operations can be performed by repositioning the tool's depth or azimuth and then creating more openings in the casing.

Figure 1:
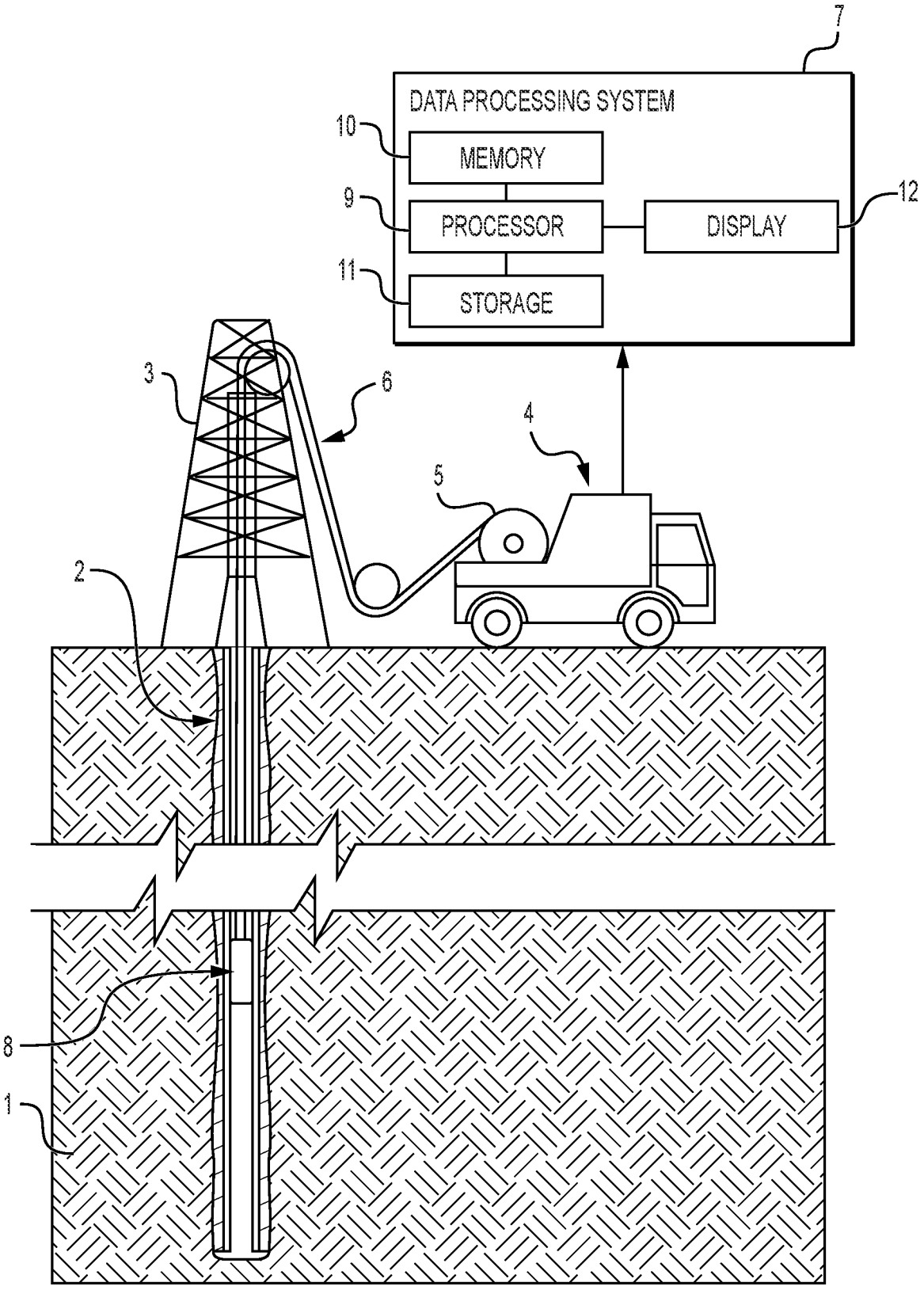
FIG. 1 is a side view of a well site where a slot cutting tool of the present invention may be used.

FIG. 1 shows an exemplary well site where a slot cutting tool of the present invention may be utilized. A formation 1 has a drilled and completed wellbore 2. A derrick 3 above ground may be used to raise and lower components into the wellbore 2 and otherwise assist with well operations.

A wireline surface system 4 at the ground level includes a wireline logging unit, a wireline depth control system 5 having a cable 6, and an electronic control system 7. The cable is connected to a connection assembly 8 that may be lowered downhole. The electronic control system 7 includes a processor 9, memory 10, storage 11, and display 12 that may be used to control various operations of the wireline surface system 4, send and receive data, and store data.

The connection assembly 8 includes equipment for mechanically and electronically connecting the slot cutting assembly with the cable 6. The cable 6 includes a support wire, such as steel, to mechanically support the weight of the slot cutting assembly and communication wire to pass communications between the slot cutting assembly and the wireline surface system 4. The slot cutting assembly, as described in more detail below, is installed below the connection assembly.

The wireline surface system 4 can deploy the cable 6, which in turn lowers the connection assembly 8 and slot cutting assembly 8 deeper downhole. Conversely, the wireline surface system 4 can retract the cable 6 and raise the connection assembly 8 and slot cutting assembly, including to the surface. The cable 6 is deployed or retracted by the wireline depth control system 5, such as by unwinding or winding the cable 6 around a spool that is driven by a motor.

The wireline logging unit communicates with the electronic control system 7 to send and receive data and control signals. For example, the wireline logging unit can communicate data received from the connection assembly 8 and slot cutting assembly to the electronic control system 7. The wireline logging unit likewise can communicate data and control signals received from the electronic control system 7 to the connection assembly 8 and slot cutting assembly.

Although FIG. 1 shows the connection assembly 8 being operated on a cable 6, the assembly 8 and associated slot cutting assembly can be attached to other types of conveyance systems, such as coil tubing. Any conveyance system can be used to mechanically support the slot cutting assembly and mechanically raise or lower it within the wellbore 2. References to a "cable" are intended to be non-limiting, instead encompassing any known conveyance system.

Figure 2:
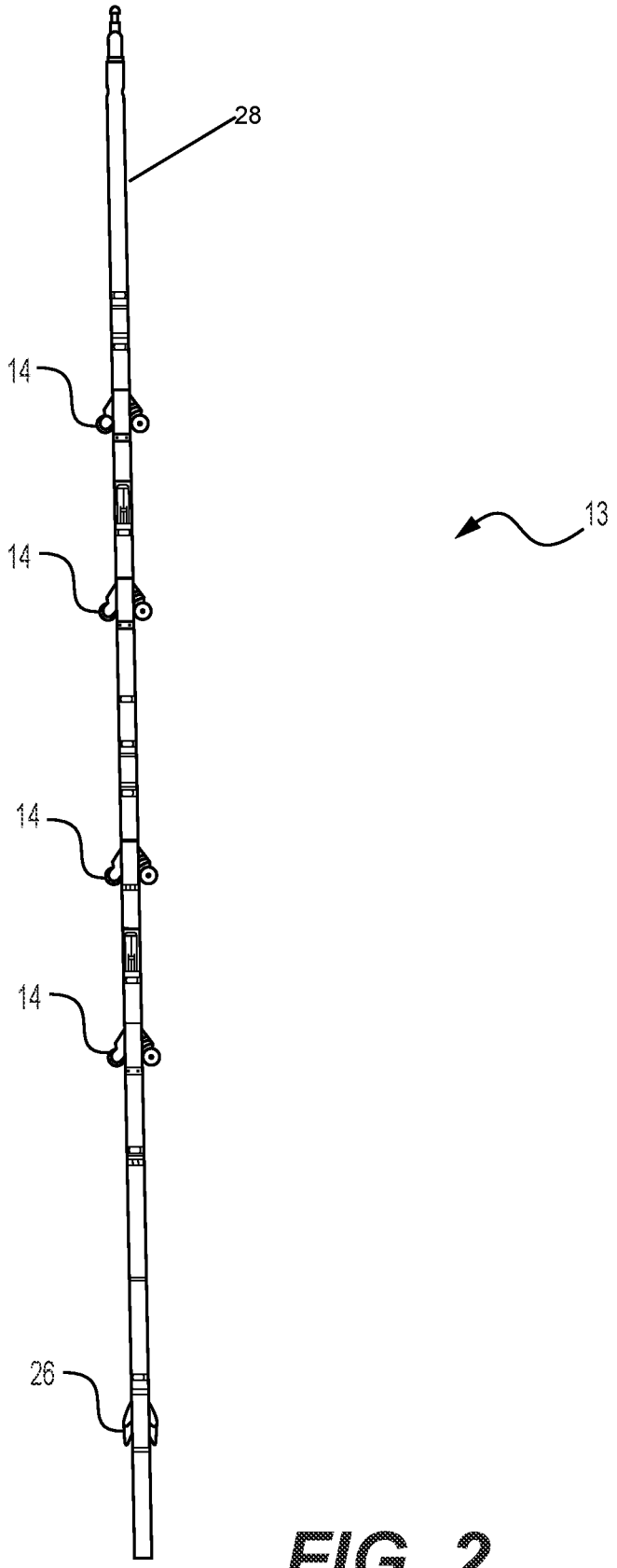
FIG. 2 is a side view of the slot cutting tool showing cutting assemblies and an anchoring system.

FIG. 2 shows a slot cutting assembly 13 with multiple slot cutting tools 14 located along the body 28 of the slot cutting tool and an anchoring system 26 located proximate one end of the body of the slot cutting tool. As will be explained in more detail later, each slot cutting tool 14 includes a blade and a stabilizing arm that can be extended or retracted. The slot cutting tools and the anchoring system may be retracted such that the diameter of the slot cutting assembly 13 viewed from above is smaller than the inner diameter of the tubing or casing. This allows the slot cutting assembly 13 to be lowered downhole through the casing.

The slot cutting assembly 13 may include communication electronics that enable the reception of commands and communication of downhole signals and status and power electronics that enable the powering and control of electronics and electromechanical systems in the slot cutting tool. The assembly 13 may include azimuthal detection that identifies the orientation of the tool, such as with respect to an external reference (e.g., gravity, the earth's magnetic field, or radioactive coupon) using accelerometers, gyros, or a magnetometer. The assembly 13 may include a correlation device that enables control of the slot cutting tool to ensure the appropriate location of planned cuts versus achieved cuts, such as a magnetic device for position identification based on magnetic tubular features, and a gamma ray sensor for position identification based on natural gamma ray emission from external formations. The tool 14 may include other measurement sensors that may be used for position, such as accelerometers or sensors that detect borehole pressure and temperature. The aforementioned electronics also may be located in the connection assembly 8.

The slot cutting assembly 13 also may include a hydraulics control system, which provides pressure generation and fluid compensation as needed to operate components in the slot cutting assembly.

As shown in FIG. 2, a slot cutting assembly 13 can include multiple slot cutting tools 14 mounted along the body. Any combinations of these slot cutting assemblies 13 can be used to make cuts. For example, an example method can include activating an anchoring system 26 to anchor the slot cutting assembly 13 within the wellbore and cutting an opening in the wellbore using one or more of the slot cutting tools 14. Any combination of the slot cutting tools 14 can be used to make the cut. For example, FIG. 2 shows four slot cutting tools 14, although the assembly 13 could include any number. Any combination of these slot cutting tools 14 can be used to make a cut, as each tool 14 is independently controlled. For example, if the four slot cutting tools 14 are referred to as A, B, C, and D, in descending order, then a cutting operation can include any combination, such as: A; A and B; C; C and D; A and C; A and D; A, B, and D; B, C, and D; and so on.

Figure 3:
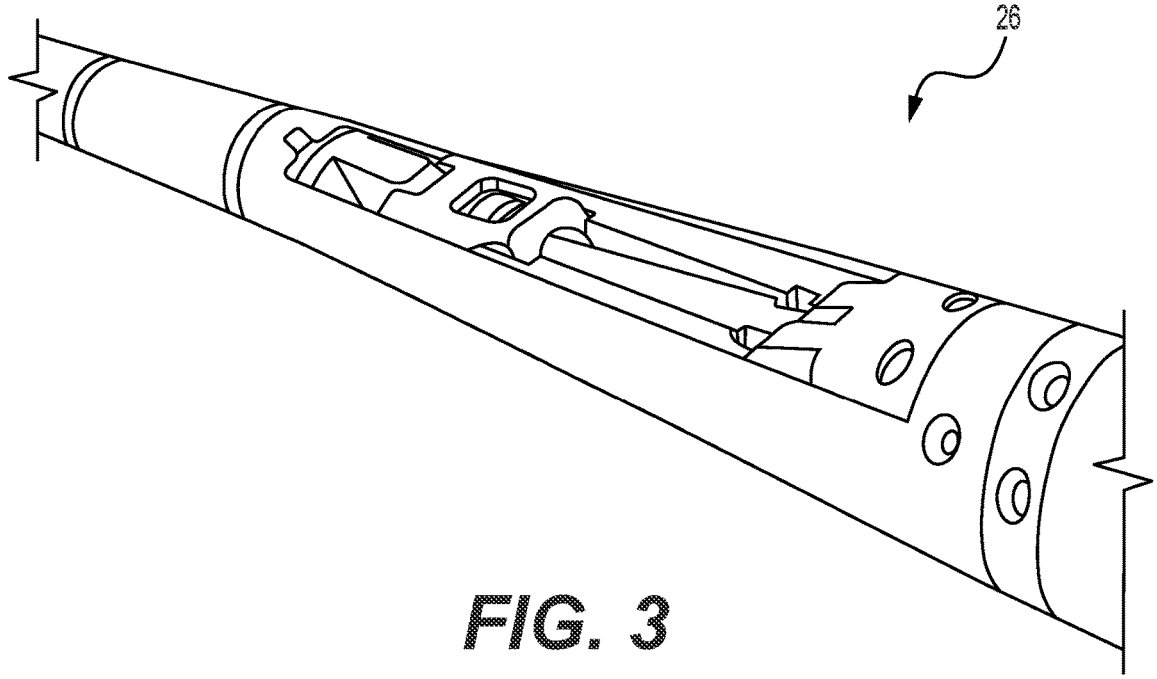
FIG. 3 is a perspective view of the anchoring system in a retracted position.

FIG. 3 shows a partial perspective view of the anchoring system 26 in a retracted or closed position. The anchoring system 26 comprises a structure and one or more anchor arms that move relative to structure between a radially contracted configuration and a radially expanded, anchoring configuration. When the anchoring system 26 in the radially contracted or closed position, it allows movement of anchoring system 26 down through a tubular and through potential restricted regions. In the example illustrated, the structure comprises a body having openings or recesses with each opening or recess sized to receive a corresponding anchor arm. When the arms are in a radially contracted/closed configuration, the arms are contained within the envelope of the tool body. Containment of the anchor arms ensures the arms do not limit the ability of anchoring system 26 to pass through restrictions and prevents the arms from causing system 26 to become caught or hung up on features during deployment or retrieval of the anchoring tool. By way of example, the body of the anchoring system 26 may comprise a cylindrical body. The anchoring system 26 also may be configured to automatically retract the extendable arms in the event of a power loss.

Figure 4:
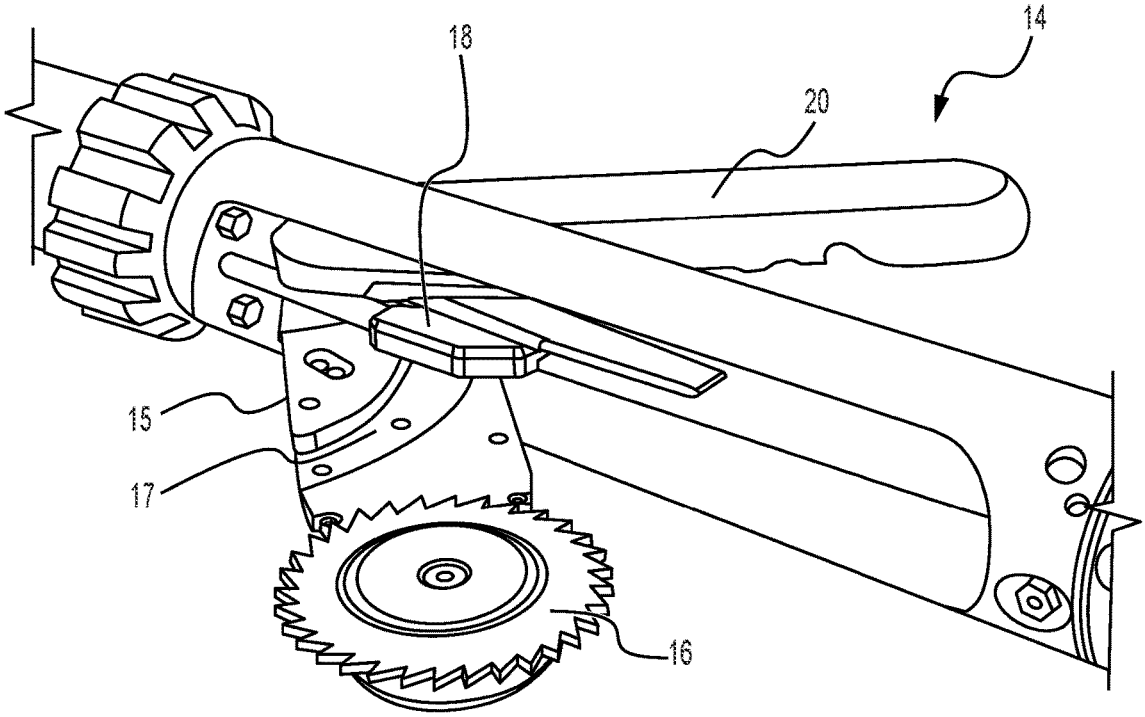
FIG. 4 is a perspective view of a slot cutting tool in an extended position.

FIG. 4 is a perspective view of a slot cutting tool 14 in an extended position. The tool has an extending arm 15 pivotally mounted at one end. The other end of the extending arm 15 includes a blade 16 rotatably mounted at the end. The blade 16 provides cutting action and may be rotated by any conventional methods, such as a belt, chain, or rotating driveshaft. The blade 16 may be powered by any conventional method for powering a downhole device, such an electric motor or hydraulics.

The extending arm 15 has a slot 17. A drive piston 18 has a pin that corresponds to the slot 17. To extend the arm 15, the drive piston 18 is retracted, moving from right to left as shown in FIG. 4. The drive piston may be powered electrically, hydraulically, or any other conventional method for powering a downhole device. The pin on the drive piston 18 contacts an edge of the slot 17 and forces the arm 15 outwards, along with the blade 16. Conversely, the drive piston 18 may be extended, moving from left to right as shown in FIG. 4, which in turn retracts the arm 15. This extension can be performed using hydraulics or an electric motor, for example.

The slot cutting tool 14 also may include a stabilizing arm 20 located generally on the opposite side of the tool from the blade 16. The stabilizing arm 20 may be extended to contact the inside of the tubular and help stabilize the slot cutting tool 14 during cutting operations by resisting forces generated by the cutting action of the blade 16. The stabilizing arm 20 may be useful to stabilize the slot cutting assembly 13 and slot cutting tool 14 when the casing is not perfectly vertical, such as in a deviated well.

The stabilizing arm 20 is pivotally mounted to the body of the slot cutting tool 14 at one end. Similar to the extending arm 15 with the blade 16, the arm 20 includes a slot. The drive piston 18 includes a pin that corresponds to this slot such that the stabilizing arm 20 is extended as the drive piston 18 is retracted, or the stabilizing arm 20 is retracted as the drive piston 18 is extended.

The end of the stabilizing arm 20 that contacts the tubular may include notches 21 (see FIG. 6) to assist with holding the end of the stabilizing arm 20 against the tubular. The end of the stabilizing arm 20 also may include a pad with higher friction to assist with gripping the tubular.

Figure 5:
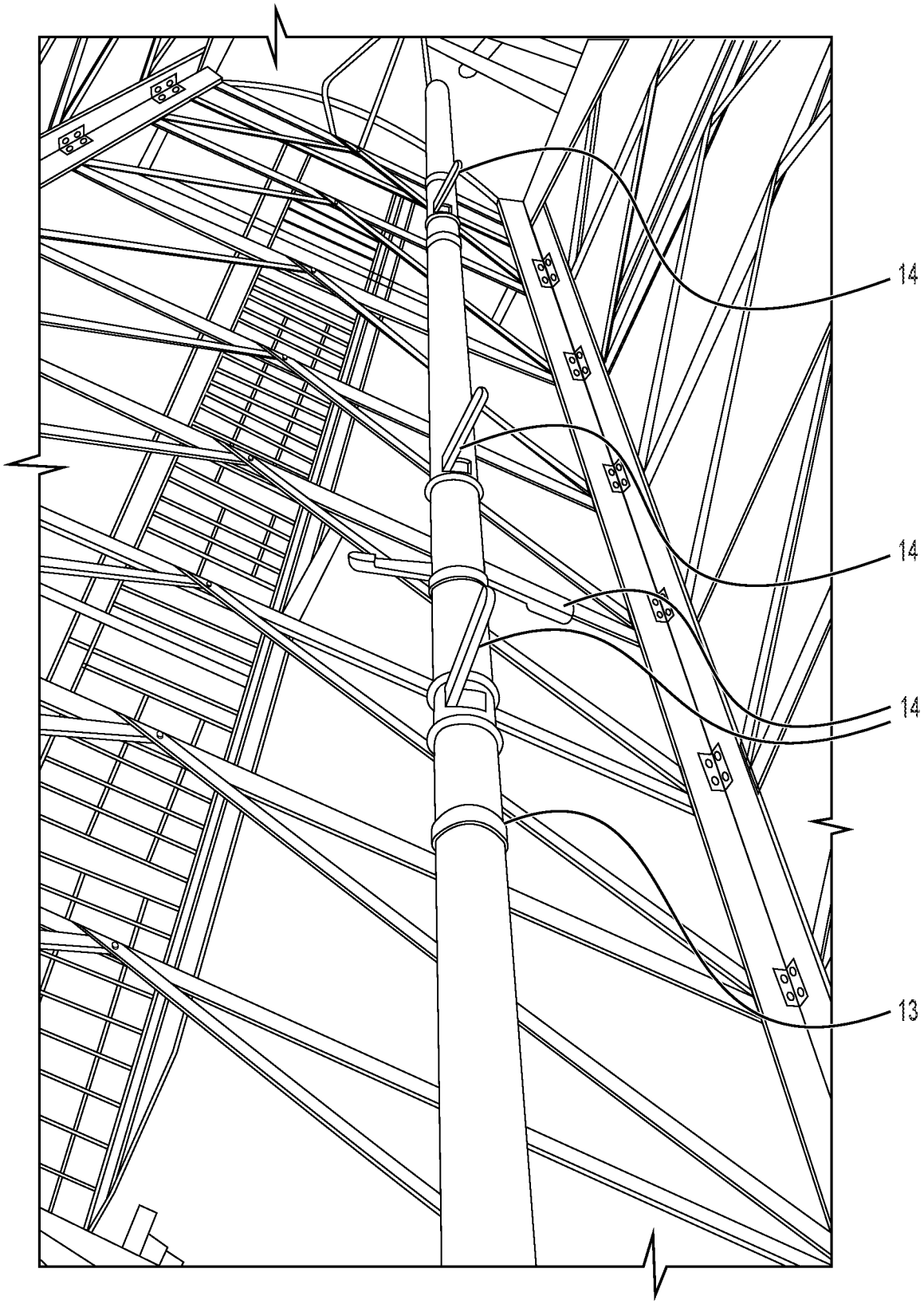
FIG. 5 is a perspective view of the slot cutting assembly above ground suspended within a derrick with slot cutting assemblies fully extended.

FIG. 5 is a perspective view of the slot cutting assembly 13 above ground suspended within a derrick 3 with the slot cutting tools 14 fully extended. As shown, the extending arms 15 with blades 16 and stabilizing arms 20 are fully extended. In this above ground position, the operation of the slot cutting assembly 13 may be tested before lowering downhole.

Figure 6:
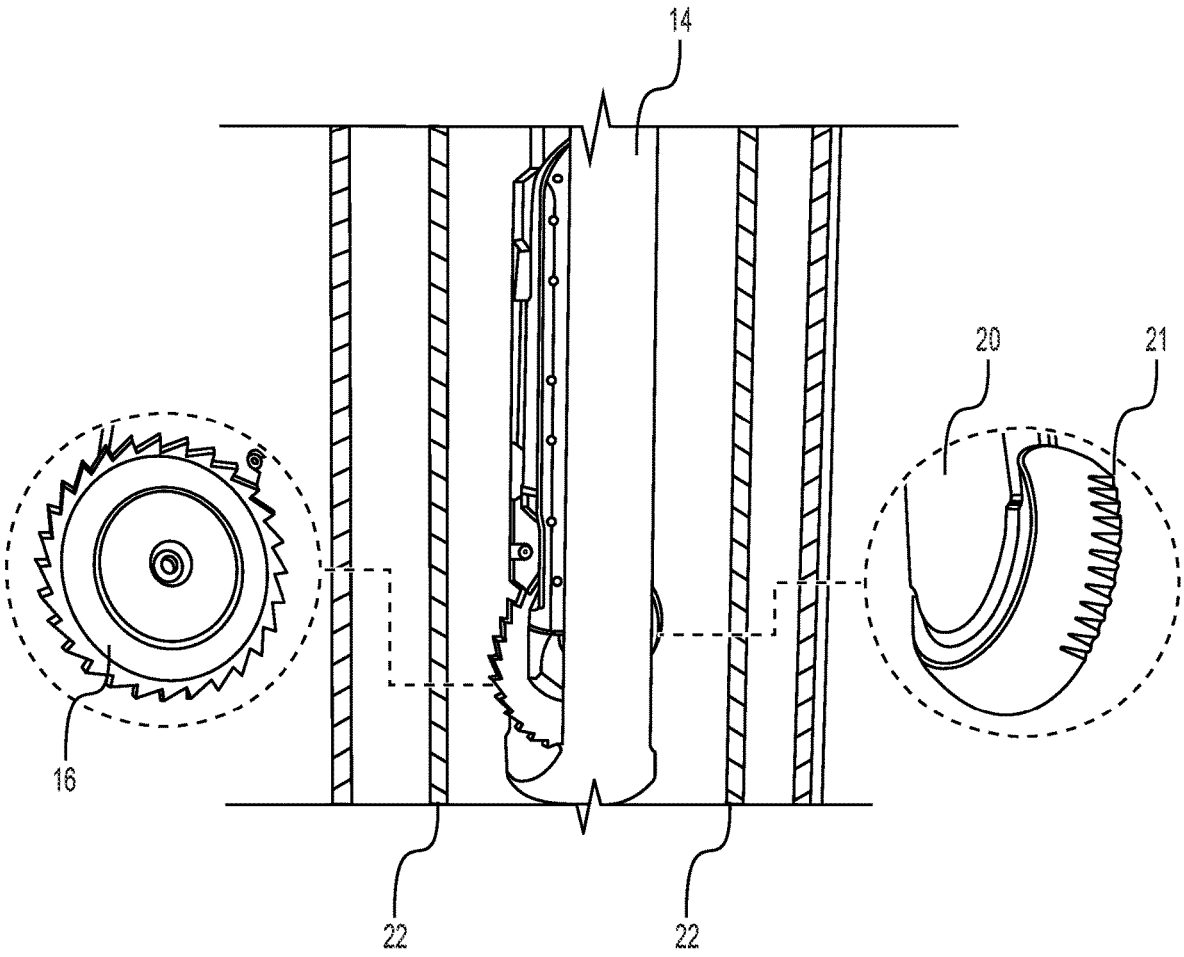
FIG. 6 is a side view of the slot cutting tool in a retracted position placed into a wellbore.

FIG. 6 is a side view of the slot cutting tool 14 in a retracted position placed into a wellbore. The wellbore has casing 22. As shown, the blade 16 and stabilizing arm 20 are fully retracted, minimizing the overall diameter of the cutting tool 14. The opposing stabilizing arm 20, which includes a stabilizing pad with notches 21, is also in a fully retracted position. In this retracted position, the slot cutting tool 14 does not contact the inside of the casing 22, which allows the tool 14 to be moved higher or lower in the wellbore or to be rotated.

Figure 7:
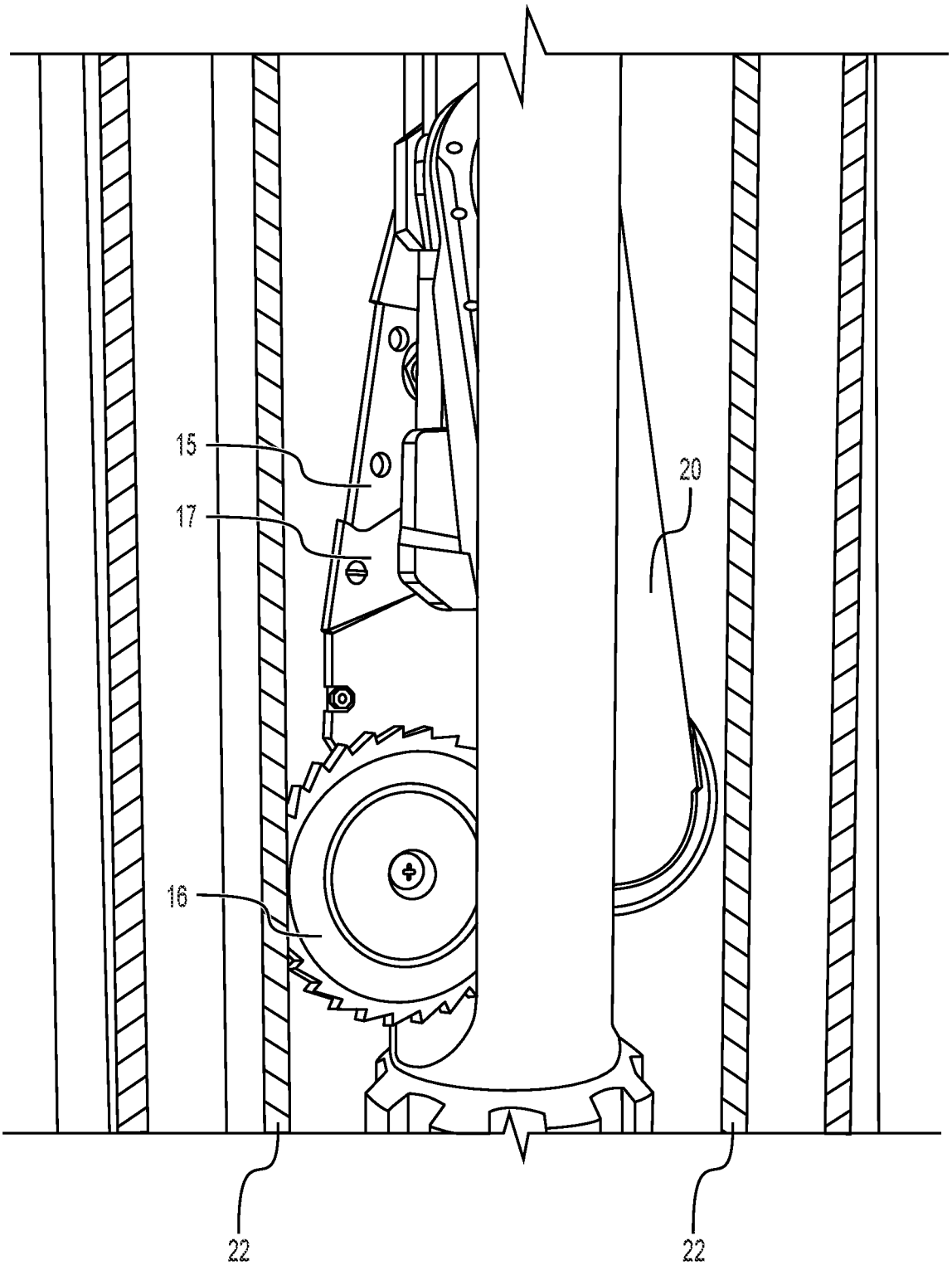
FIG. 7 is a side view of the slot cutting tool in the wellbore depicting cutting operations.

FIG. 7 is a side view of the slot cutting tool in the wellbore depicting cutting operations. As shown, the blade 16 has cut into the casing 22. The slot cutting assembly 13 may include sensors to detect the amount that the blade arm 15 and stabilizing arm 20 have been extended and the force that the blade 16 has applied to the casing. These sensors may be used by preprogrammed computer settings to control when the arms 15, 20 stop extending or when to stop the cutting action of the blades 16. The blade arm 15 continues to extend until the desired amount of cutting is achieved. This may be measured by force exerted by the blade arm, amount of flow detected from the wellbore, or any other sensors on the slot cutting assembly 13. The slot cutting assembly 13 also may be configured to automatically retract the arms 15, 20 in the event of a power loss.

The stabilizing arm 20 may contact the casing on the side opposite the blade to provide stability and leverage for the cutting. In FIG. 7, the arm 20 is almost in contact with the inner casing 22 wall and will make contact with additional extension of the arms 15, 20.

A slot cutting tool 14 may be activated and controlled independently of any other slot cutting tools 14 in the slot cutting assembly 13. Thus, the various slot cutting tools 14 shown in FIG. 2 and in FIG. 5 are not required to be activated or operated in unison. A slot cutting tool 14 may have a different degree of arm 15 extension, blade 16 speed, or degree of stabilizing arm 20 extension than other slot cutting tools in the slot cutting assembly 13.

The slot cutting assembly 13 also may include a centralizing assembly. The centralizing assembly may be useful to stabilize the slot cutting assembly when the casing is not perfectly vertical, such as in a deviated well. This assembly has extendable arms that contact the inside of the tubular and help stabilize the slot cutting assembly 13 during cutting operation by resisting forces generated by the cutting action of the blades 16. For example, a device similar to the anchoring system 26 described above may be used as a centralizing assembly. The centralizing assembly can be passive or active—for example, it can be actuated on demand to perform a centralizing function when desired.

Turning back to FIG. 2 and FIG. 6, the slot cutting assembly 13 may have multiple slot cutting tools 14. The cutting tools 14 can be oriented so that they are in alignment when viewed from the top, as shown in FIG. 2. Alternatively, slot cutting tools 14 may be oriented such that they are in staggered positions when viewed from above. For example, a slot cutting tool 14 may be staggered by 90 degrees from an adjacent slot cutting tool 14, as shown in FIG. 5, or any other desired angle of offset.

In another variation, individual cutting tools 14 are azimuthally rotatable with respect to other cutting tools 14 on the same cutting assembly 13. This allows the azimuthal orientation of the slot cutting tools 14 to be oriented with respect to other slot cutting tools 14 while the slot cutting assembly 13 is downhole. Thus, the relative orientation of the cutting tools 14 may be changed from the alignment shown in FIG. 2 to the staggered alignment shows in FIG. 5. One benefit of this downhole rotation feature is that the slot cutting assembly does not need to be lifted to the surface to re-orient the various slot cutting tools 14.

In one or more embodiments, a single cutting operation can be performed. The cutting operation can include deploying the cable 6 using the wireline surface system 4 so that the slot cutting tool 14 is at a target depth. The target depth is confirmed using a sensor on the slot cutting assembly 13, such as a collar finder or other depth finding tool, a surface unit, or combinations thereof. The target depth also may be confirmed by a depth correlation process, such as measuring the length of cable 6 deployed. Then the slot cutting assembly tool 14 is azimuthally oriented so that the cut will be performed in a predetermined target direction within the casing. This orientation may be achieved by manipulating the slot cutting assembly 13 from the surface, such as rotating the cable, or using an active orientating device known in the art.

The position and orientation of the cut into the casing may be determined based on flow distribution or to prevent damage of target components, such as completion lines or other downhole components. Once the orientation is determined to be proper, the extendable arms 40 of the anchoring system 26 are deployed to hold the slot cutting assembly 13 within the casing. A centralizing assembly also may be deployed to add stability to the slot cutting assembly 13 within the casing. Slot cutting then may begin.

To begin cutting operations, the blade 16 is activated and the arm 15 is deployed until the now spinning blade cuts into and through the casing 22 and the desired amount of the surrounding formation. During the cutting operation, measurements using sensors on the slot cutting assembly 13 can be taken to confirm that the cut is performed at a proper depth. For example, the slot cutting assembly 13 can be configured to determine the depth of cut and compare the depth of cut to a predetermined depth that is required to establish flow, or measured parameters can be sent to the wireline surface system 4 and an operator or processor at the surface can confirm that the cut depth matches a predetermined depth. The arm 15 continues to deploy and push the spinning blade 16 into the casing 22 until either a target response is seen in a series of cutting sensor responses to confirm full cut or a target response is seen in any number of wellbore sensors to confirm cut completed.

In another embodiment, simultaneous cutting operations can be performed. For example, two or more slot cutting tools 14 may be activated so that multiple cuts through the casing may be performed at the same time, thereby decreasing the amount of time to create holes as compared to cutting holes one at a time.

Singular or simultaneous cutting operations also may be performed in a sequence to manage available power. In one embodiment, one or more holes may be cut by certain slot cutting tools 14, then additional holes may be cut by different slot cutting tools 14. In another embodiment, one or more holes may be cut, then the slot cutting assembly 13 may be repositioned to a different depth or azimuth to create additional holes.

In another embodiment, multiple cutting operations may be performed so that holes in excess of the number of slot cutting tools 14 may be created. For example, the slot cutting assembly 13 in FIG. 2 has four slot cutting tools 14. By making repeated cuts, the slot cutting assembly 13 may create five or more holes in the casing or tubular.

Pattern cutting can be used to ensure flow optimization from the formation around the casing. The spacing of holes in a pattern cut can be predetermined to ensure structural integrity of the casing and prevent having to cut additional holes in that region. Pattern cutting also can be used to avoid damaging equipment downhole, such as joints, safety valves, and inflow control devices. The pattern also be cut so that holes are created along one place or region to ensure symmetric production from the surrounding formation.

One example of a pattern is azimuthal cutting, whereby one or more holes are cut by one or more slot cutting tools 14. After these holes are completed, the depth of the slot cutting assembly 13 is maintained but the tool is rotated to change the azimuthal orientation so that additional holes are created at the same depth. Another example of a pattern is linear cutting, whereby multiple holes are cut at different depths and along the same azimuthal orientation. As can be appreciated, the slot cutting assembly 13 can create various patterns of slots simultaneously or in sequence, and it can create more slots than slot cutting tools on the assembly by performing multiple cutting operations. These cutting operations can be performed without removing the slot cutting assembly 13 to the surface.

Control of the slot cutting assembly 13 and its slot cutting tools 14 is controlled by the wireline surface system 4. A user at the surface can provide individual commands that are sent to the slot cutting assembly 13. A user also can send a preset sequence of commands that will operate the slot cutting assembly and its slot cutting tools in a targeted sequence of events. For example, the preset command could instruct the slot cutting assembly 13 to perform multiple cuts by a single slot cutting tool 14 or instruct the assembly to perform multiple cuts by several slot cutting tools 14. In this manner, the cutting operations are automated and do not require a user to provide every individual command to the slot cutting assembly 13. The slot cutting assembly 13 may include a processor and a computer readable medium configured with computer instructions that receive signals from sensors. Based on the signals, the processor determines the depth of cut, azimuth, anchor deployment, and serval other parameters. The determined parameters can be used by the processor to control the cutting operation, sent to the surface for an operator to act upon, or sent to a surface device that controls the cutting operations using the parameters.

Other examples of the disclosure will be apparent to those skilled in the art from consideration of the specification and practice of the examples disclosed herein. Though some of the described methods have been presented as a series of steps, it should be appreciated that one or more steps can occur simultaneously, in an overlapping fashion, or in a different order. The order of steps presented are only illustrative of the possibilities and those steps can be executed or performed in any suitable fashion. Moreover, the various features of the examples described here are not mutually exclusive. Rather any feature of any example described here can be incorporated into any other suitable example. It is intended that the specification and examples be considered as exemplary only, with a true scope and spirit of the disclosure being indicated by the following claims.

What is claimed is:

1. A slot cutting assembly for cutting one or more openings in a wellbore tubular, comprising:

a body;

an anchoring system mounted along the body for anchoring the slot cutting assembly within the wellbore tubular;

a slot cutting tool mounted along the body comprising:

an extendable arm having two ends wherein the first end is pivotably mounted with respect to the body;

a cutting blade rotatably mounted to the second end of the extendable arm; and an extendable stabilizing arm mounted along the body on the opposite side of the tool from the extendable arm, wherein the first end of the extendable stabilizing arm is pivotably mounted where the first end of the extendable arm is pivotably mounted.

2. The slot cutting assembly of claim 1, further comprising two or more slot cutting tools mounted along the body.

3. The slot cutting assembly of claim 1, further comprising sensors capable of detecting the depth and azimuth of the slot cutting tool within a wellbore.

4. The slot cutting assembly of claim 1, further comprising an azimuth orientation system for adjusting the azimuthal orientation of the slot cutting assembly in a wellbore.

5. The slot cutting assembly of claim 1, further comprising a sensor capable of detecting the angular amount that the extendable arm has extended.

6. The slot cutting assembly of claim 1, further comprising a sensor capable of detecting the force exerted by the extendable arm against the wellbore tubular.

7. The slot cutting assembly of claim 1, further comprising a centralizing assembly.

8. A method for cutting one or more openings in a wellbore tubular using a slot cutting assembly having a body, comprising:

activating an anchoring system mounted along the body to anchor the slot cutting assembly within the wellbore tubular;

cutting an opening in the wellbore tubular using a slot cutting tool mounted along the body, the slot cutting tool comprising:

an extendable arm having two ends wherein the first end is pivotably mounted with respect to the body;

a cutting blade rotatably mounted to the second end of the extendable arm; and an extendable stabilizing arm mounted along the body on the opposite side of the tool from the extendable arm, wherein the first end of the extendable stabilizing arm is pivotably mounted where the first end of the extendable arm is pivotably mounted.

9. The method of claim 8, further comprising:

adjusting the depth or azimuth position of the slot cutting assembly within the wellbore; and cutting an opening in the wellbore tubular using the slot cutting tool.

10. The method of claim 8, wherein the slot cutting assembly comprises a plurality of slot cutting tools mounted along the body.

11. The method of claim 10, wherein cutting an opening in the wellbore tubular comprises using the plurality of slot cutting tools to perform the cutting.

12. The method of claim 10, wherein cutting an opening in the wellbore tubular comprises operating only a subset of the plurality of slot cutting tools to perform the cutting.

13. The method of claim 10, wherein cutting an opening in the wellbore tubular comprises operating a first cutting tool of the plurality of cutting tools and, after the first cutting tool is cut an opening, operating a second cutting tool of the plurality of cutting tools.

14. A method for cutting one or more openings in a wellbore tubular using a slot cutting assembly having a body and sensors capable of detecting the depth and azimuth of the slot cutting assembly within a wellbore, the method comprising:

setting the depth or azimuth of the slot cutting assembly within the wellbore using a surface system comprising:

a cable having a distal end attached to the slot cutting tool;

a cable deployment system for extending and retrieving the cable; and a non-transitory, computer-readable medium comprising instructions that, when executed by a processor, sets the depth or azimuth of the slot cutting tool within the wellbore using information from the sensors; and cutting an opening in the wellbore tubular using a slot cutting tool mounted along the body of the slot cutting assembly, the slot cutting tool comprising:

an extendable arm having two ends wherein the first end is pivotably mounted with respect to the body;

a cutting blade rotatably mounted to the second end of the extendable arm; and an extendable stabilizing arm mounted along the body on the opposite side of the tool from the extendable arm, wherein the first end of the extendable stabilizing arm is pivotably mounted where the first end of the extendable arm is pivotably mounted.

15. The method of claim 14, further comprising:

adjusting the depth or azimuth position of the slot cutting tool within the wellbore; and cutting an opening in the wellbore tubular using the slot cutting tool.

16. The method of claim 14, the slot cutting assembly further comprising:

two or more slot cutting tools mounted along the body.

17. The method of claim 14, wherein cutting an opening in the wellbore tubular comprises using the two or more slot cutting tools to perform the cutting.

18. The method of claim 14, wherein cutting an opening in the wellbore tubular comprises operating only a subset of the two or more slot cutting tools to perform the cutting.

19. The method of claim 14, wherein cutting an opening in the wellbore tubular comprises operating a first cutting tool of the two or more cutting tools and, after the first cutting tool is cut an opening, operating a second cutting tool of the two or more cutting tools.

* * * * *